US006463716B1

(12) United States Patent
Focke et al.

(10) Patent No.: US 6,463,716 B1
(45) **Date of Patent: *Oct. 15, 2002**

(54) PACKAGING MACHINE FOR CIGARETTES

(75) Inventors: Heinz Focke, Verden (DE); Hans-Jürgen Bretthauer, Bremen (DE)

(73) Assignee: Focke & Co. (GmbH & Co.), Verden (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/436,700

(22) Filed: Nov. 9, 1999

(30) Foreign Application Priority Data

Nov. 10, 1998 (DE) ..... 198 51 775

(51) Int. Cl.[7] ..... B65B 7/00
(52) U.S. Cl. ..... 53/370.3; 53/228; 53/377.4
(58) Field of Search ..... 53/370.3, 377.4, 53/383.1, 228, 234; 156/578, 389

(56) References Cited

U.S. PATENT DOCUMENTS 4,253,903 A * 3/1981 McDonald
4,261,782 A * 4/1981 Teed
4,316,755 A * 2/1982 Flaum et al.
4,428,794 A * 1/1984 Hayskar et al.
4,530,202 A * 7/1985 Powell et al.
4,544,436 A * 10/1985 Itoh et al.
5,683,753 A 11/1997 Yamaguchi et al.
5,846,376 A * 12/1998 Gossett et al.
5,912,054 A 6/1999 Tateyama

FOREIGN PATENT DOCUMENTS

| | | |
|---|---|---|
| DE | 25 48 255 | 2/1978 |
| DE | 39 15 549 | 11/1990 |
| DE | 41 13 445 | 10/1991 |
| DE | 43 34 745 | 4/1995 |
| DE | 196 39 260 | 3/1998 |
| DE | 196 48 445 | 5/1998 |
| DE | 197 19 198 | 11/1998 |
| EP | 486 159 | 5/1992 |
| EP | 647 562 | 4/1995 |
| EP | 0 835 810 | 4/1998 |

* cited by examiner

*Primary Examiner*—Eugene Kim
(74) *Attorney, Agent, or Firm*—Sughrue Mion, PLLC

(57) ABSTRACT

Glue nozzles (14) are used for the purpose of transferring glue to packs (10). Said glue nozzles can be moved by a pivot arm (18) into a maintenance position, in which the glue nozzle (14) is located alternatively above a collecting container (24) for portions of glue or above a water container (25). The water container (25) is assigned a rotatable roller (22) which is made of elastic material, in particular foam, and assumes the function of a cleaning and closure element for the glue nozzle (14).

5 Claims, 11 Drawing Sheets

47
62
72
49
48
58
23
52
53
51
63
65
64
59
57

PACKAGING MACHINE FOR CIGARETTES

BACKGROUND OF THE INVENTION

The invention relates to a packaging machine, in particular for producing cigarette packs, having at least one glue subassembly which has at least one glue nozzle and is intended for applying glue to blanks of the packs.

Glue is used in all areas of packaging technology for the purpose of connecting folding tabs. This also applies, in particular, to the production of cigarette packs. Glue subassemblies with glue nozzles are being used more and more for the purpose of applying (spots of) glue. An example of glue being applied to blanks of soft-carton packs is disclosed in EP 835 810. However, such glue subassemblies with glue nozzles may also be used in other, related areas of technology, for example in the production of cigarettes.

The correct functioning of the glue nozzles over a relatively long period of time is problematic. The causes reside, particularly, in the properties of the glue, which sets comparatively quickly. In the case of breaks in operation, in particular, this results in undesired closure of the glue nozzles.

SUMMARY OF THE INVENTION

The object of the invention is to improve the reliable operation of glue subassemblies with glue nozzles, namely to ensure relatively long, disruption-free operation of such glue subassemblies.

In order to achieve this object, the glue nozzle is assigned an elastic closure and cleaning element which can be moved relative thereto, in particular a rotatable roller, disc or the like made of elastic material.

The closure and cleaning element has to fulfill a double function. During a break in operation, on the one hand the cleaning movement, namely a rotation in particular, cleans the glue nozzle. On the other hand, the element acts as a sealing closure means for the nozzle mouth, with the result that, when operation resumes, the glue nozzle can function immediately.

According to a further feature of the invention, the closure and cleaning element is assigned a supply of solvent for glue, in particular water, the closure and cleaning element, on account of the movement, dipping into the solvent and feeding the latter (constantly) to the glue nozzle for the purpose of eliminating set glue.

The glue nozzle is cleaned and closed, preferably in a maintenance or cleaning position, which is remote from the operating position of the glue nozzle. A cleaning subassembly is positioned correspondingly and the glue nozzle or the glue subassembly is mounted in a moveable manner.

Further features of the invention relate to the configuration of the glue subassembly and of the cleaning subassembly and to the positioning of the latter.

BRIEF DESCRIPTION OF THE DRAWINGS

Further details and features of the invention are explained in more detail below with reference to exemplary embodiments illustrated in the drawings, in which.

DETAILED DESCRIPTION OF THE DRAWINGS

Figure 1:
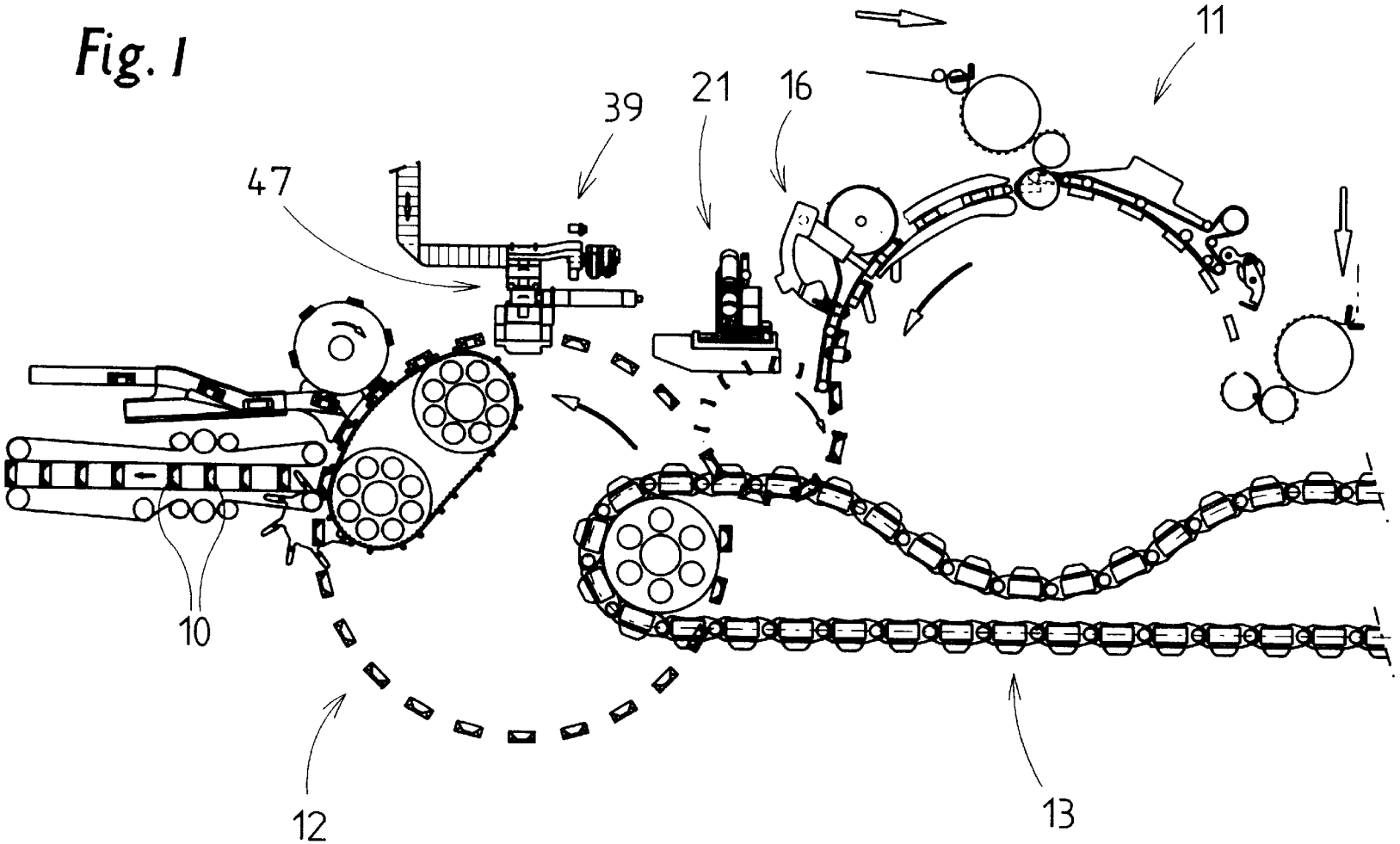
FIG. 1 shows a vastly simplified side view of a sub-region of a packaging machine.

The drawings show an advantageous application for the configuration of glue subassemblies in packaging technology. The invention concerns the production of (cigarette) packs 10 of the soft-carton type. The packaging machine, which is shown schematically in FIG. 1, comprises a folding turret 11 and a downstream drying turret 12. Cigarette groups are fed, as contents of the packs 10, to the folding turret 11 by a pocket chain 13. The construction and functioning of the packaging machine can be gathered, for example, from U.S. Pat. No. 5 784 855.

The packaging machine has a plurality of glue subassemblies for the purpose of transferring glue to blanks of the packs 10 to folding tabs. The glue subassemblies are each equipped with glue nozzles 14, 15 by means of which portions of glue are transferred to the pack 10 or parts of the same.

A first glue subassembly 16 is located in the region of the folding turret 11 and is positioned in a stationary manner on the outer circumference thereof. The glue subassembly 16 serves for applying glue to base-side folding tabs of the pack 10, namely to the inside of an outer longitudinal tab 17 of a base wall of the pack 10. The procedures for applying the glue to said longitudinal tab 17 can be gathered, for example, from EP 835 810. It can be seen from this that a subassembly 16 has in each case a plurality of glue nozzles 14 located one beside the other in order to transfer a plurality of spots of glue at the same time.

Figure 2:
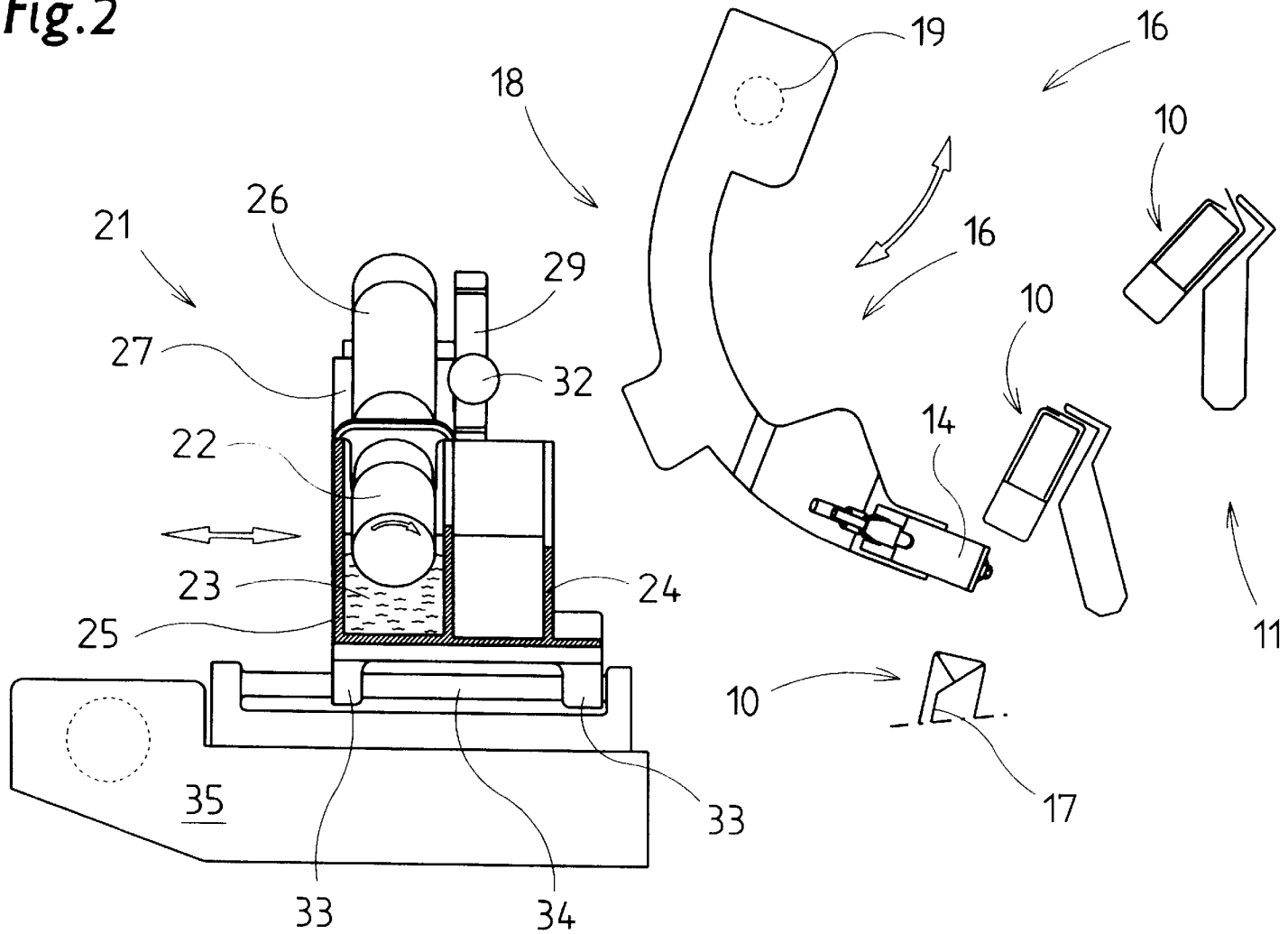
FIG. 2 shows, on an enlarged scale, a side view of a detail of the packaging machine, namely a glue subassembly.
Figure 3:
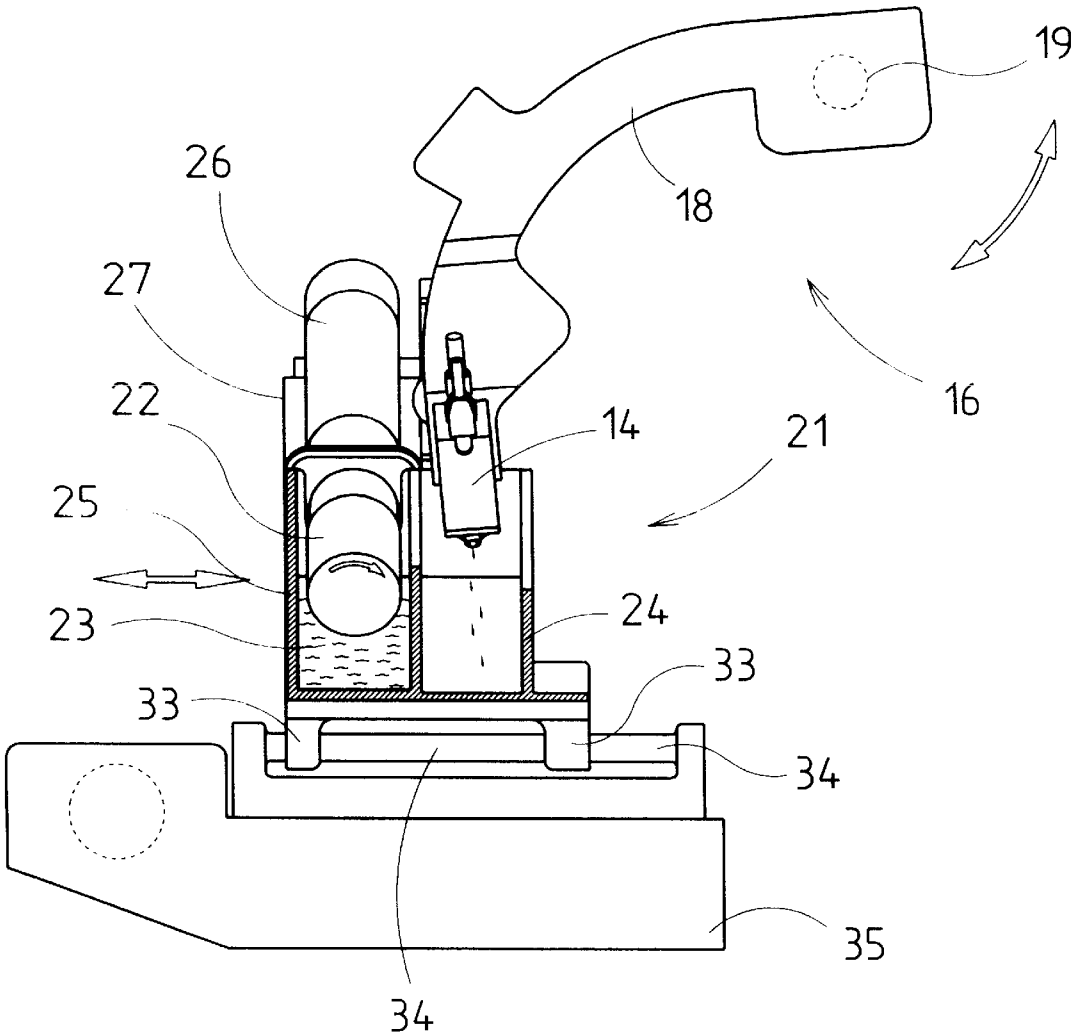
FIG. 3 shows the detail according to FIG. 2 with the position of the glue subassembly changed.
Figure 4:
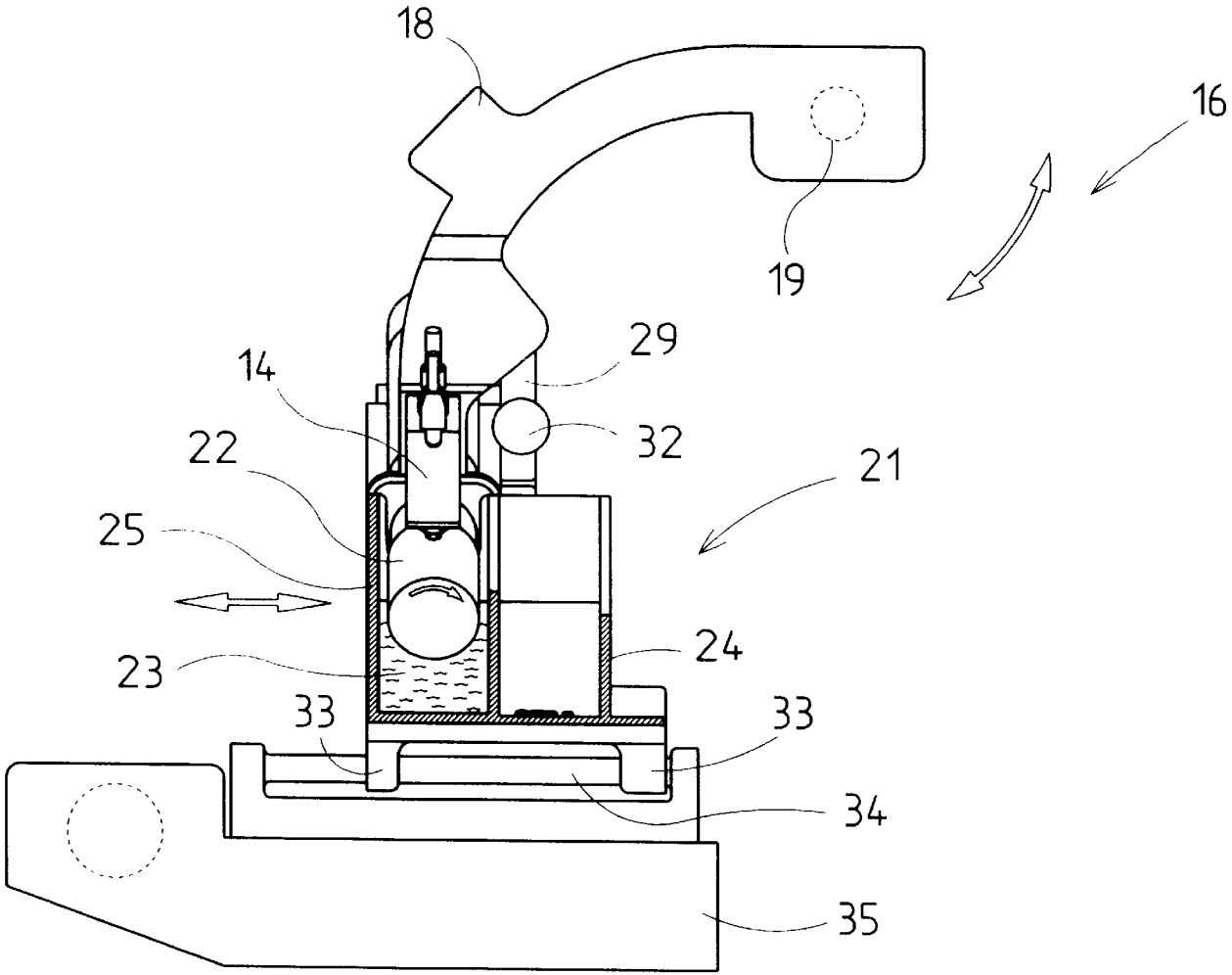
FIG. 4 shows the detail according to FIGS. 2 and 3 with the position of the glue subassembly changed again.
Figure 5:
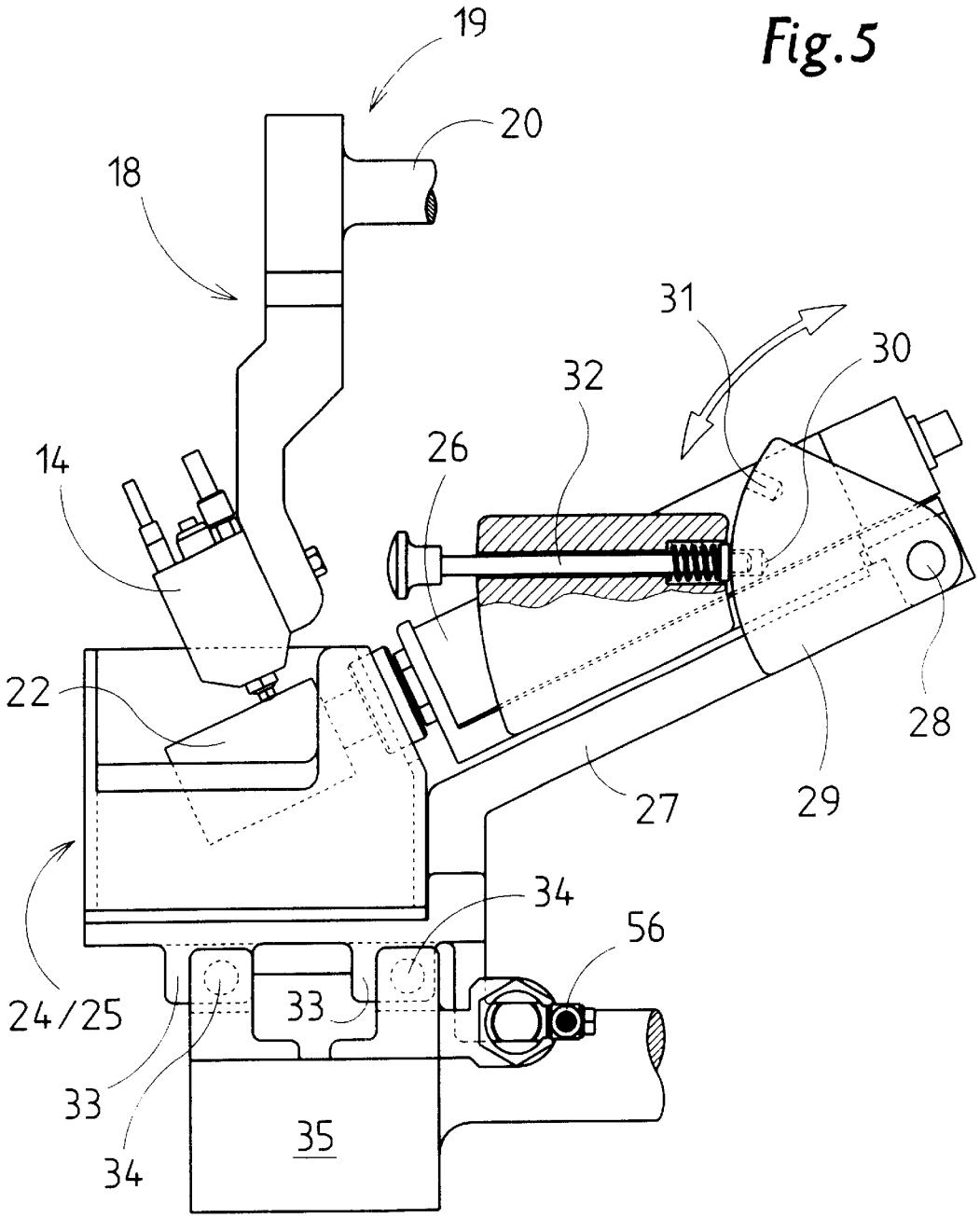
FIG. 5 shows a transverse view, partially in section, of the glue subassembly according to FIGS. 2 to 4.

The glue nozzle 14 (or the nozzle unit comprising a plurality of nozzles arranged one beside the other) can be moved between an operating position (FIG. 2) and a maintenance or cleaning or standby position (FIGS. 3 and 4). For this purpose, the glue nozzle 14 is mounted on an arcuate pivot arm 18 which can be pivoted about a rotary bearing 19 which is remote from the glue nozzle 14, to be precise by way of a transversely directed shaft journal 20 (FIG. 5) which is driven in a suitable manner. In the operating position (FIG. 2), the glue nozzle 14 is directed obliquely in order to ensure an optimum feed direction for the portions of glue during transfer to the longitudinal tabs 17.

In the case of a temporary break in operation, the glue nozzle 14 is drawn back from the operating position, by actuation of the pivot arm 18, into a maintenance or cleaning position. In this position, the glue nozzle 14 is located in the region of a maintenance subassembly 21. In the latter, first of all the glue nozzle 14 is cleaned of any residues of set glue present.

Furthermore, the glue nozzle 14 is closed in sealing manner until it is used again.

For this purpose, the glue nozzle 14 is assigned a closure and cleaning element. In the case of the present exemplary embodiment, the latter comprises a (cylindrical) roller 22 made of elastic material, such as rubber, plastic or the like. The (cleaning and closure) roller 22 preferably consists of an elastic foam, for example foam rubber or foamed plastic. A particularly suitable material is fine-cell polyester foam with open cells on the cylindrical lateral surface of the roller 22.

Figure 8:
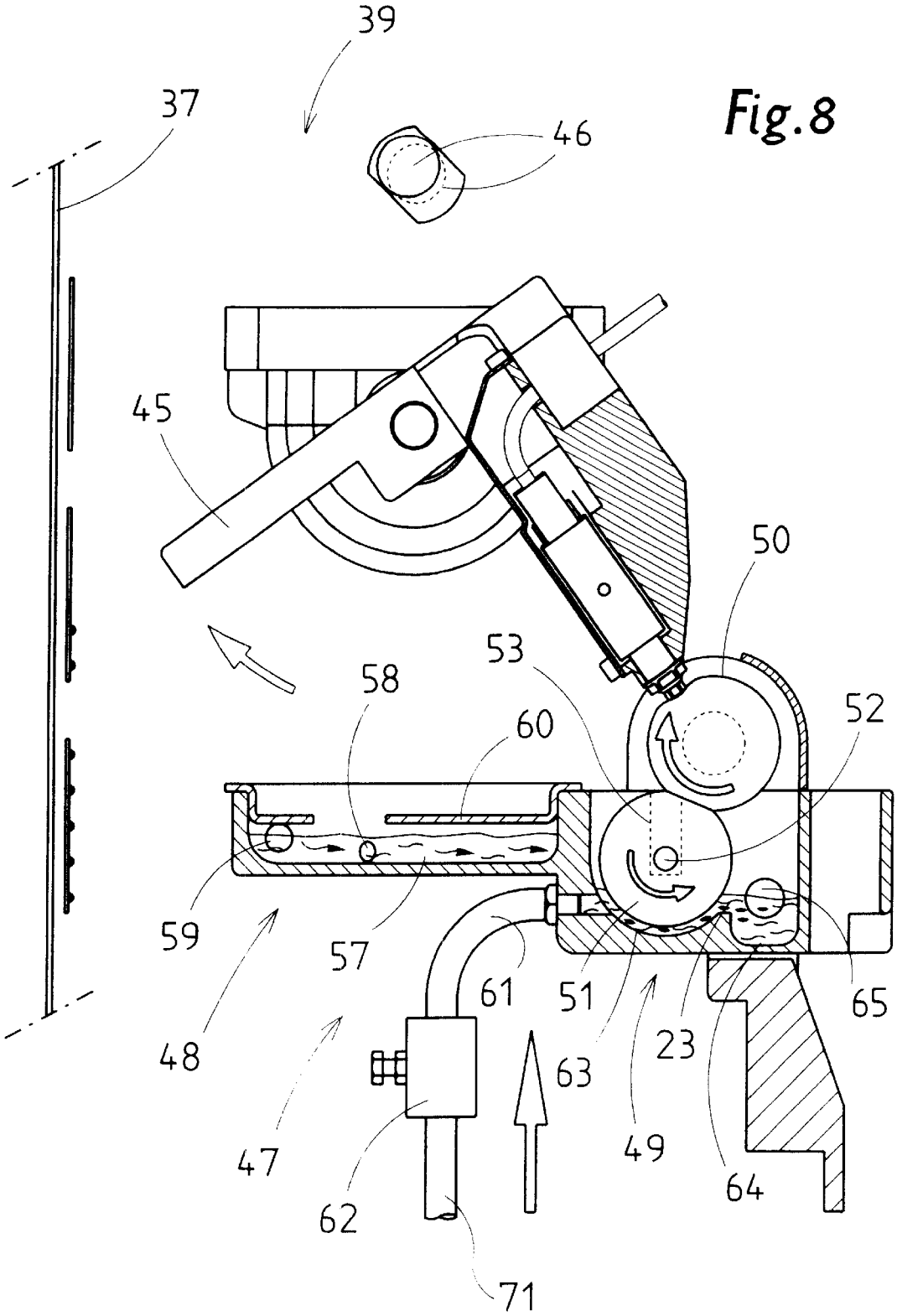
FIG. 8 shows the glue subassembly according to FIGS. 6 and 7 in a cleaning position.

The roller 22 has a double function. On the one hand, it closes the glue nozzle 14 or a nozzle mouth in a sealing manner by virtue of the glue nozzle 14 butting against the circumference of the elastic roller 22. The relative positioning is selected in this case such that the glue nozzle or the nozzle head presses elastically into the roller 22 (FIG. 8).

On the other hand, the roller 22 is a cleaning element. By virtue of (temporary) rotation relative to the stationary glue nozzle 14, the latter is cleaned in the region of the nozzle mouth.

In this case, the roller 22 may carry along a solvent, for example water, in order to improve the elimination of set glue from the glue nozzle 14. For this purpose, the roller 22 (which is driven in rotation) has a sub-region of its circumference dipping into a supply of solvent, for example into a water bath 23. The structure of the roller 22, in particular the foam formation, means that water is constantly carried along and transferred to the glue nozzle 14.

Moreover, the maintenance subassembly 21 allows the glue nozzles 14 to be actuated on a trial basis by discharging portions of glue in the drawn-back position. Such trial portions of glue are received by a collecting container.

In the case of the present exemplary embodiment, the maintenance subassembly 21 forms a unit comprising two containers located one beside the other and connected to one another, namely the collecting container 24, on the one hand, and a water container 25, on the other hand. The roller 22 is mounted as a cylindrical structure in the region of the water container 25, to be precise with an obliquely directed axis of rotation. The relative positioning is selected such that, in the cleaning or closure position, the glue nozzle 14 is directed at right angles to the lateral surface of the roller 22.

For the roller 22 to be driven in rotation, the maintenance subassembly 21 is assigned a drive motor 26. The latter is connected to a mount 27 which, for its part, is fastened on the water container 25, namely on an upright wall of the same. The drive motor 26 is connected to said mount 27 via a rotary bearing 28 and can thus be pivoted in relation to the mount 27. Upwardly directed pivoting movement moves the drive motor 26 out of the operating position, the roller 22 being carried along in the process. Said roller is then located outside the water container 25 and can be exchanged if it is worn or damaged. A segment 29 with two latching holes 30, 31 is provided on the mount 27. Passing into the said latching holes is a latching pin 32 which can be actuated by hand and fixes the operating position (FIG. 5) and the position of the roller 22 outside the water container 25.

The unit of the maintenance subassembly 21 can be displaced (by a linear unit 56). In the case of the present exemplary embodiment, the glue nozzle 14 can be moved into a single cleaning and maintenance position. In order, on the one hand, to carry out a trial operation of the glue nozzle 14 and, on the other hand, to ensure the cleaning and closure of the same, the maintenance subassembly 21 can be displaced relative to the glue nozzle 14. For this purpose, the maintenance subassembly rests with sliding guides 33 on guide rods 34. By virtue of transverse displacement of the maintenance subassembly 21, the glue nozzle 14 is positioned alternatively in the region of the collecting container 24 or of the water container 25, or in the region of the roller 22 (FIGS. 3 and 4). The entire maintenance subassembly 21 rests on a supporting base 35, which is connected to the machine framework.

A glue subassembly which is not shown and is intended for applying glue to side tabs of the pack blank (EP 835 810) may be designed analogously to the above-described glue subassembly 16 with maintenance subassembly 21.

Figure 9:
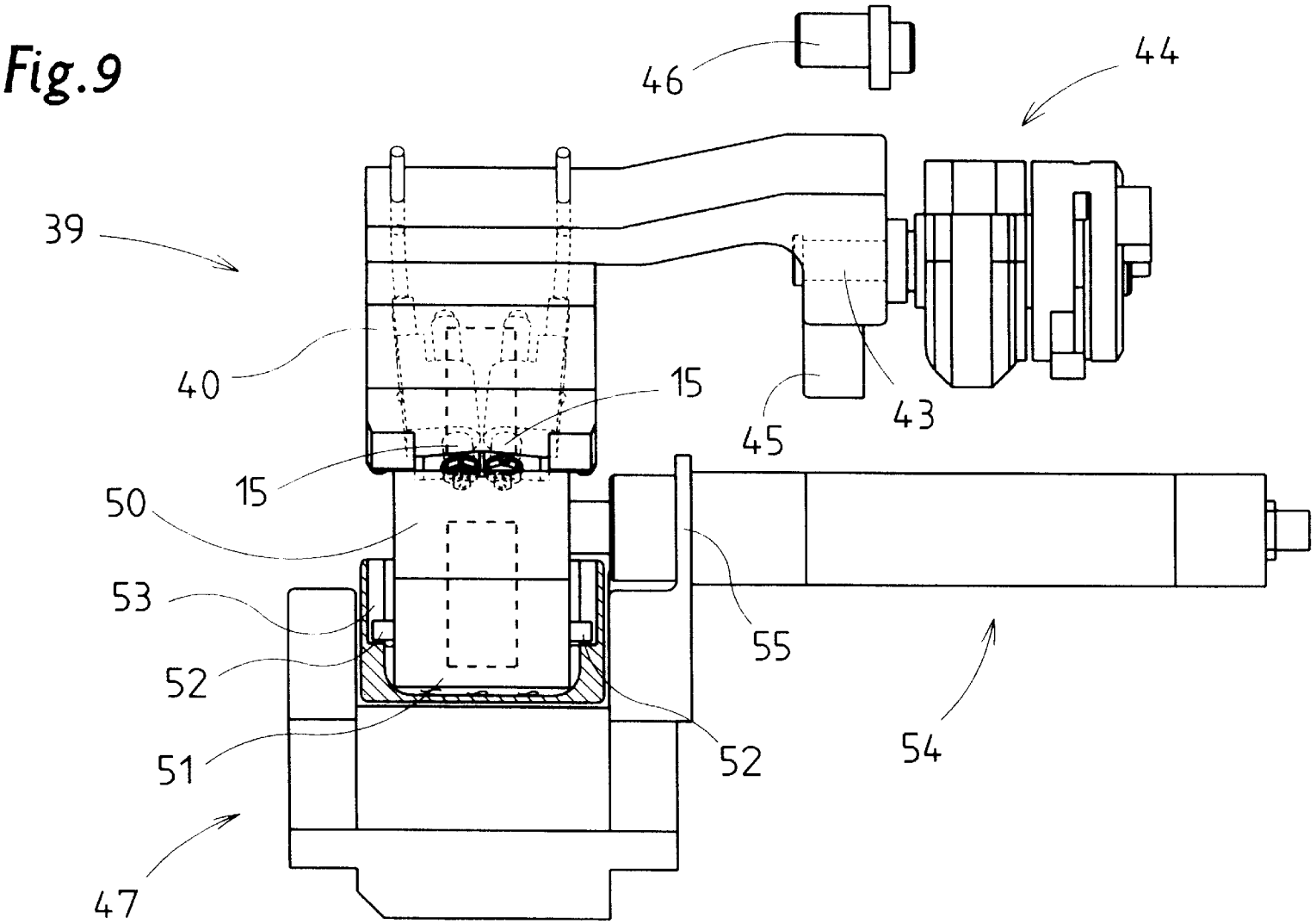
FIG. 9 shows a transverse view, partially in section, of the glue subassembly according to FIGS. 6 to 8, to be precise in a cleaning position.
Figure 10:
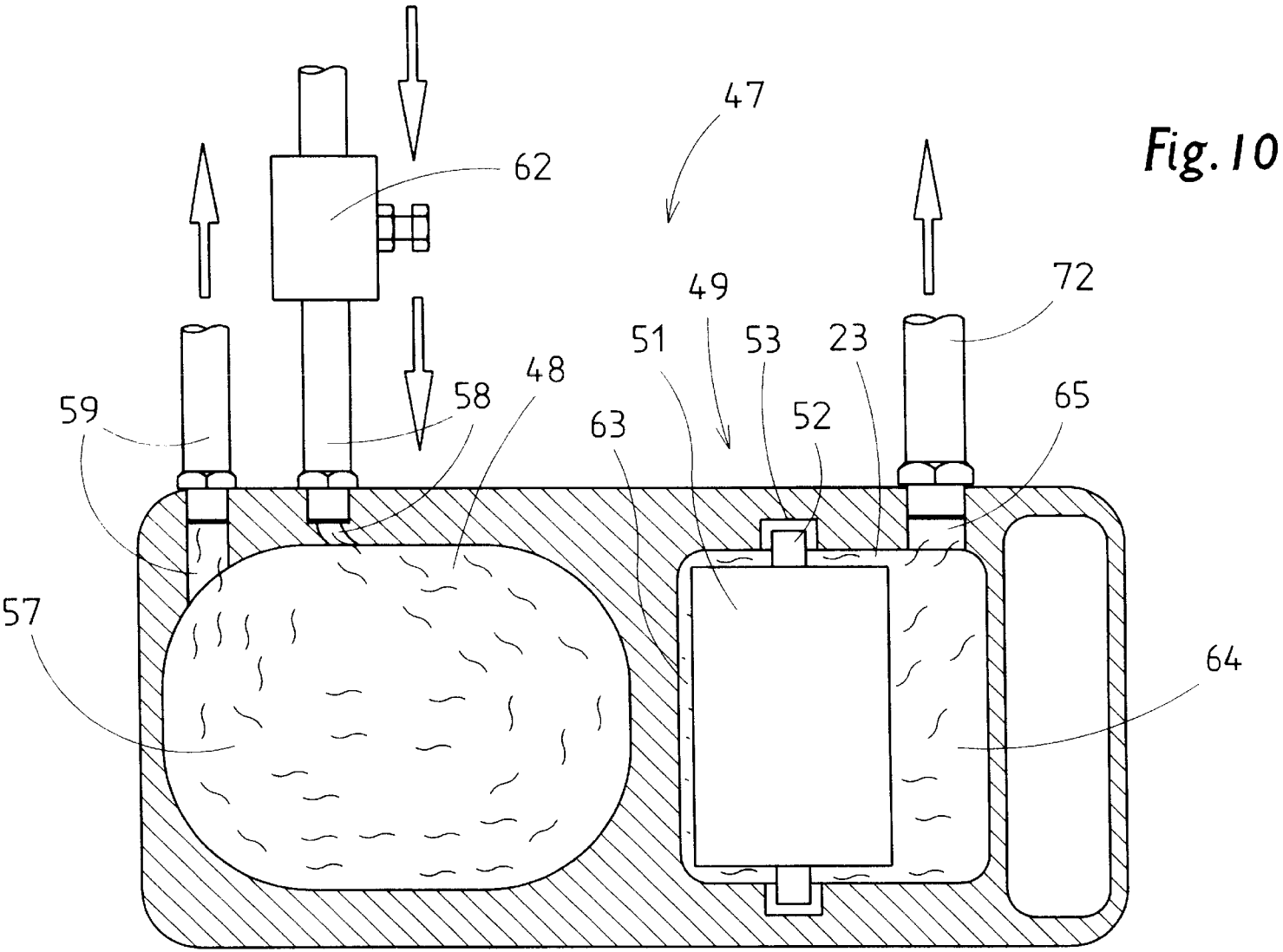
FIG. 10 shows a partial area of a maintenance subassembly for glue nozzles, in plan view or horizontal section, on an enlarged scale, FIG. 11 a system for supplying the maintenance subassembly with water and for disposing glue residues from it.

In the case of cigarette packs, it is conventional to provide a band (or revenue stamp) 36 with glue. In the case of a pack 10 of the soft-carton type, said band extends transversely over an end surface of the pack. Lateral legs of the band 36 are connected by adhesive bonding to large-surface-area front and rear walls. 15 (EP 0 842 856). For the feed of glue, the bands 36 are conveyed by a band conveyor 37 (suction belt) in a vertical plane, namely downwards. Glue nozzles 15 are positioned at an angle—obliquely downwards—for the purpose of transferring spots of glue 38. Two glue nozzles 15 are positioned one beside the other (FIG. 9) for the purpose of applying two rows of spots of glue 38 to each band.

The two glue nozzles 15 are part of a glue subassembly 39 in the region of the drying turret 12 (FIG. 1). The glue subassembly 39 is positioned in a stationary manner adjacent to the drying turret 12.

The (two) glue nozzles 15 are positioned one beside the other in or on a support 40. The support 40 has one or two depressions 41, in which the glue nozzles 15 are located. Towards the free side, the depression 41 is provided with a covering 42 made of sheet metal or the like, with the result that the glue nozzles 15 are located in an encapsulated chamber.

The support 40 is retained on an eccentric or offset rotary bearing 43. The support 40 with the glue nozzles 15 can be moved about said rotary bearing 43 out of the operating position according to FIG. 6 into a first maintenance position according to FIG. 7 with downward directed glue nozzles 15 and into a cleaning and closure position according to FIG. 8 with obliquely directed glue nozzles 15. In the region of the rotary bearing 43, a drive subassembly 44 causes a rotary journal of the rotary bearing 43 to rotate. A transversely projecting arm 45 determines the precise position of the glue nozzles 15 in the operating position according to FIG. 6, to be precise by virtue of abutment against a stop 46. The latter is designed as an eccentric and thus, by virtue of rotation, allows different stop positions so that the operating position of the nozzles 15 can be adjusted.

Figure 6:
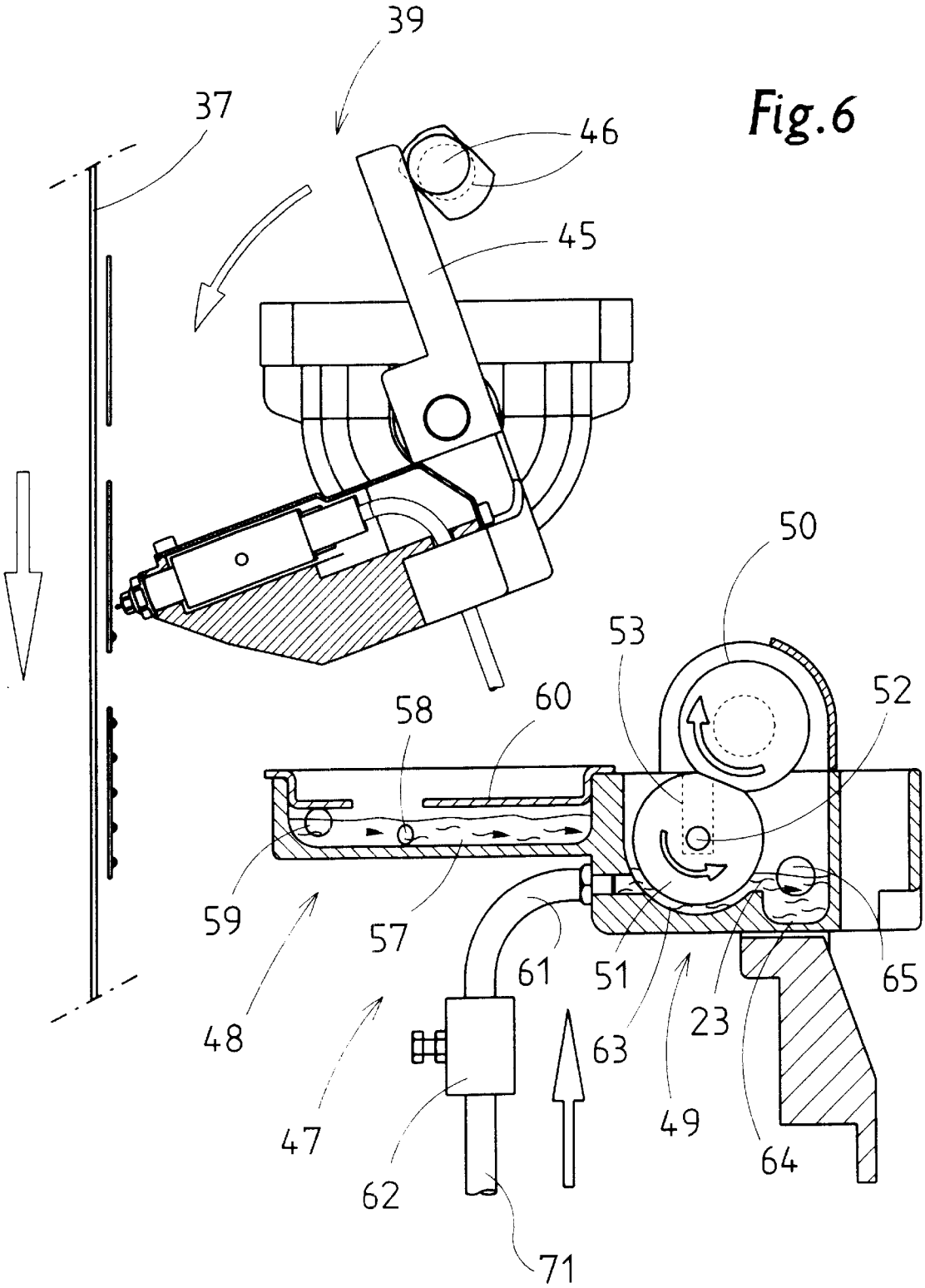
FIG. 6 shows a side view, partially in vertical section, of a glue subassembly for another application.
Figure 7:
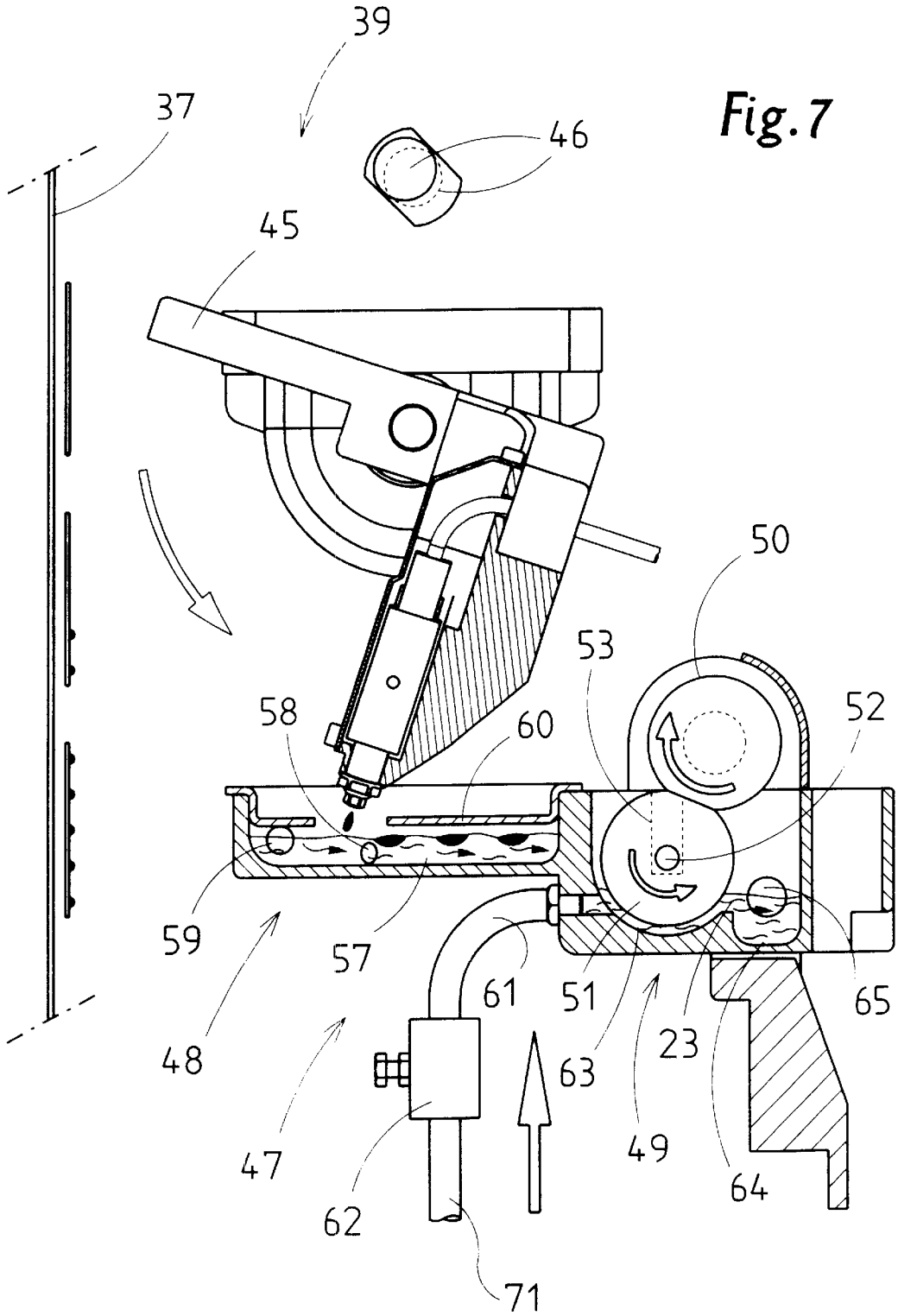
FIG. 7 shows the glue subassembly according to FIG. 6 in a different operating position.

A maintenance subassembly 47 is designed distantly from the exemplary embodiment of FIG. 2 ff. A collecting basin 48 and a water basin 49 are connected to one another to form a unit. The glue subassembly 39 or the support 40 with the glue nozzles 15 can be moved into two positions—outside the operating position (FIG. 6). In the first position according to FIG. 7, above the collecting basin 48, portions of glue can be discharged on a trial basis and are received by the collecting basin 48. In an oblique position according to FIG. 8, the glue nozzles 15 butt against the lateral surface of a roller 50 made of elastic material, in particular elastic foam. The roller 50 is located outside or above the water basin 49. A separate transfer roller 51 dips into the water of the water basin 49 and, on account of rotation, transfers water to the roller 50 or the lateral surface thereof. The transfer roller 51 is mounted by way of spindle ends 52 in an upwardly open recess 53 in mutually opposite, upright walls of the water basin 49, and can thus be removed freely in the upward direction.

The roller 50 is connected to a transversely located drive motor 54. The latter is mounted in an annular mount 55 of the water basin 49 or alongside the water basin. The drive motor 54 can be drawn out of the mount 55 together with the roller 50 for the possible exchange of the roller 50.

A further special feature is the design of the maintenance subassembly 47 according to FIG. 6 to FIG. 10 and the supply and discharge system for it.

A supply of water 57 is constantly kept in the collecting basin 48. The latter catches the glue portions discharged in the position according to FIG. 7 to keep them from adhering to the walls of the collecting basin. The glue portions are partially dissolved in the process but in any case are carried off by the water in the collecting basin 48.

For this purpose water is fed constantly or intermittently to the water supply 57, namely by means of a water inlet 58. To ensure a constant circulation of water, the connecting basin 48 is connected to a water outlet 59 which is positioned approximately at the same height as the upper level of the water supply 57. The collecting basin 48 is provided on its upper side with a cover 60, which has an opening through which the glue portions can pass.

The part of the maintenance subassembly 47 which has rollers 50, 51 also works with a moving current of solvents or water. Connected to the water basin 49 is a feed pipe 61 for solvents or water. The feed pipe 61 opens into the water basin 49 in the horizontal direction, specifically directly adjacent to the transfer roller 51. The feed pipe 61 is provided with a regulating element, namely with a one-way restrictor 62. The latter can be used to regulate the amount of liquid flowing into the water basin 49, but without any reflux action being possible. The feed pipe 61 can also be configured as a tube underneath the one-way restrictor 62.

The lower area on the bottom side of the water basin 49 is contoured. In the area of the transfer roller 51 there is formed a cylindrical-shaped base pan 63, which conforms to the shape of the transfer roller 51. This base pan 63 forms a gap relative to the transfer roller 51 for the water bath 23.

Directly following the base pan 63 is a recess 64 within the water basin 49. In this region, water is collected for discharge out of the water basin 49 and carried off by means of a flowing-out hole 65.

Figure 11:
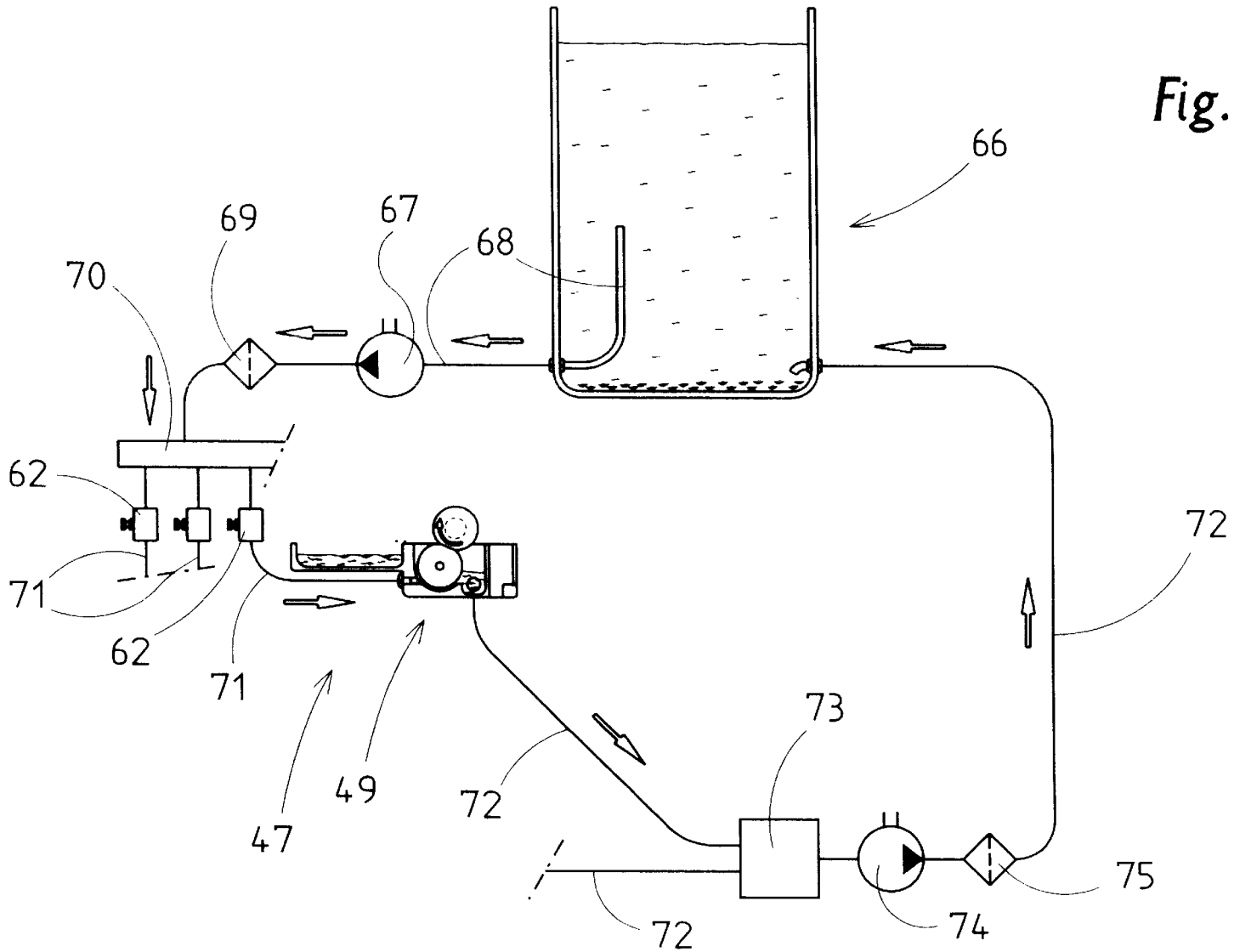

With respect to the flowing media, the maintenance subassembly 47—in particular in conjunction with further glue subassemblies of the packaging machine—is connected to a common circulation system as shown in FIG. 11. The exemplary embodiment shown here relates to the supply and discharge system for the water basin 49.

A central supply tank 66 contains a sufficient amount of liquid or water for supplying a plurality, or all, of the glue subassemblies for the packaging machine. Water is taken from the supply tank 66 by means of pump 67 via a withdrawal line 68. The water is conducted through filter 69 to a distributor element, namely to divider 70. This is followed by delivery lines 71 to the individual glue subassemblies or to their respective water basins 49. The delivery lines 71 lead into the feed pipe 61.

The flowing-out hole 65 of the water basin 49 is connected to a return flow line 72, which leads to the supply tank 66 and flows into a lower region of same. A first part of the return flow line 72 leads to a collecting tank 73, to which the return flow lines 72 of other glue subassemblies are also connected. Proceeding from the collecting tank 73, the common part of the return flow line 72 lead through a pump 74 and a filter 75 to the supply tank 66. Depending on the circumstances, small amounts of glue residue may collect at its bottom, which can be removed over the course of lengthier intervals.

L i s t o f d e s i a n a t i o n s

10 pack
11 folding turret
12 drying turret
13 pocket chain
14 glue nozzle
15 glue nozzle
16 glue subassembly
17 longitudinal tab
18 pivot arm
19 rotary bearing
20 shaft journal
21 maintenance subassembly
22 roller
23 water bath
24 collecting container
25 water container
26 drive motor
27 mount
28 rotary bearing
29 segment
30 latching hole
31 latching hole
32 latching pin
33 sliding guide
34 guide rod
35 supporting base
36 band (revenue stamp)
37 band conveyor
38 spot of glue
39 glue subassembly
40 support
41 depression
42 cvering
43 rotary bearing
44 drive subassembly
45 arm
46 stop
47 maintenance subassembly
48 collecting basin
49 water basin
50 roller
51 transfer roller
52 spindle end
53 recess
54 drive motor
55 mount
56 linear unit
57 supply of water
58 water inlet
59 water outlet
60 cover
61 feed pipe
62 one-way restrictor
63 base pan
64 recess
65 flowing-out hole
66 supply tank
67 pump
68 withdrawal line

69 filter
70 divider
71 delivery line
72 return flow line
73 collecting tank
74 pump
75 filter

What is claimed is:

1. A packaging machine with a rotating folding turret (11) for folding blanks for packs (10) and with a glue assembly (16, 39) having at least one glue nozzle (14, 15) for applying glue to the blanks of the packs (10), the glue assembly (16, 39) being movable between an operating position, associated with the folding turret (11), and a retracted maintenance and cleaning position, said packaging machine, comprising a stationary maintenance assembly (21, 47) in a region of the maintenance and cleaning position of the glue assembly (16, 39), said maintenance assembly comprising one of a water container (25) and a water basin (49), and one of a collecting container (24) and a collecting basin (48) for catching glue portions from glue nozzles (14, 15), wherein:

in the maintenance and cleaning position, the glue assembly (16,39) is positioned above the maintenance assembly (21, 47);

in a first position of the glue assembly (16, 39), the glue assembly (16, 39) is located above the collecting container (24) or above the water basin (49);

while the glue assembly (16, 39) is positioned above the water container (25) or water basin (49), nozzles (14, 15) of the glue assembly (16, 39) butt against an intermittently rotating roller (22, 50) made of elastic material serving as a closure and cleaning member for the nozzles (14, 15);

the roller (22, 50) is mounted above the water container (25) or water basin (49) and partially dips into a bath, containing a glue solvent, within the water container (25) or within the water basin (29); and in a second position, in a region of the maintenance assembly (21, 47), the glue assembly (16, 39) is located above the collecting container (24) or above the collecting basin (48) for catching glue portions that are discharged for testing purposes by the glue assembly (16, 39) before a return thereof to said operating position.

2. The packaging machine according to claim 1, wherein the glue assembly (16, 39) with the glue nozzles (14, 15) is movable by a pivot arm (18) from said operating position into a region of the water container (25) or the water basin (49) and subsequently into a region of the collecting container (24) or the collecting basin (48) and then back into said operating position.

3. The packaging machine according to claim 1, wherein the maintenance assembly (21) is transversely displaceable, relative to the glue assembly (16) in said retracted position, in such a way that the water container (25) with said roller (22) or the collecting container (24) is positioned below a glue nozzle (14) of the glue assembly (16).

4. The packaging machine according to claim 1, wherein:

a) the glue assembly (16) is mounted on a pivot arm (18), b) the glue assembly (16) is positioned in said operating position with glue nozzles (14) radially directed at the folding turret (11), and c) the pivot arm (18) is actuatable to advancethe glue assembly (16) to the maintenance assembly (21), which is positioned in place adjacent to the folding turret (11), such that the glue assembly (16), with essentially downward directed glue nozzles (14), is positioned above the roller (22) or above the collecting container (24).

5. A packaging machine for manufacturing packs (10) with a band label (36) attached to each pack (10) by glue, and having a glue assembly (39) with at least one glue nozzle (14) for applying glue to the band label (36), the glue assembly (39) being movable between an operating position, facing band labels (36), and a retracted position for maintenance and cleaning, the nozzle (15) being covered by an elastic closure element in the retracted maintenance and cleaning position, wherein:

a) the band labels (36) are transportable by a band conveyor (37) in a vertical plane, b) the glue assembly (39) is mounted in place adjacent to the band conveyor (37) and is pivotable by an arm (45), c) in said operating position, the glue nozzles (15) are positioned adjacent to the band conveyor (37) and point downward at a slant angle, d) in the retracted maintenance and cleaning position, the glue nozzles (15) are brought by pivotal movement into a position above a maintenance assembly (21, 47), e) the maintenance assembly (21, 47) comprises a collecting basin (48) for glue portions from the glue nozzles (15), and a water basin (49) with water into which an intermittently rotating roller (50) made of elastic material is dipped, and f) the glue assembly (39) in the retracted maintenance and cleaning position is movable above the maintenance assembly so that the glue nozzles (15) are alternatively directed at the collecting basin (48) or lie on a circumference of the roller (50) above the water basin (49).

* * * * *